US006116995A

United States Patent [19]

Chao

[11] Patent Number: 6,116,995

[45] Date of Patent: Sep. 12, 2000

[54] DRILL BIT SHARPENING APPARATUS

[76] Inventor: Yu Yi Chao, No. 134-1, Lane Chuan-tou, Ying-pu Shiang, Da-du Chuen, Taijung Hsien, Taiwan

[21] Appl. No.: 09/307,612

[22] Filed: May 10, 1999

[51] Int. Cl.[7] ..... B24B 23/00

[52] U.S. Cl. ..... 451/351; 451/48; 451/321; 451/556

[58] Field of Search ..... 451/48, 359, 321, 451/556

[56] References Cited

U.S. PATENT DOCUMENTS

| | | | |
|---|---|---|---|
| 4,860,497 | 8/1989 | Ohya et al. | 451/48 |
| 4,974,372 | 12/1990 | Chantalat | 451/48 |
| 5,400,546 | 3/1995 | Christian et al. | 451/143 |

*Primary Examiner*—David A. Scherbel
*Assistant Examiner*—Shantese McDonald
*Attorney, Agent, or Firm*—Dougherty & Troxell

[57] ABSTRACT

An object of the present invention is to provide an apparatus which is suitable for sharpening the drill bits of both the power drill and hand drill. Additionally, the operation of said apparatus is simple, and the sharpening is accurate.

3 Claims, 6 Drawing Sheets

DRILL BIT SHARPENING APPARATUS

BACKGROUND OF THE APPLICATION

Power drills and hand drills utilize the rotational energy to rotate the bits in high speed for drilling articles. The spur of bits will grow dull after a period of utilization, and need to be sharpened. The lifetime of a bit can last longer if the sharpening procedure is accurate. There are two conventional sharpeners for drill bits commonly used in the field as follows:

Referring the structural drawing of FIG. 1, the indicated sharpener for hand drills comprises a body (1) including an axis (11) installed therein by a bearing (12) and it is parted as two portions enveloped by an axis sleeve (14) and an inner axis sleeve (111) respectively; an abrasive wheel (13) mounted on the axis sleeve (14); a base plate (15) with several annular aligned inserting holes (151) possessing different radii from 3.6–10 m/m; a beveled groove (152) positioned under the inserting holes (151) and the spur of bit can emerge therefrom to contact with the abrasive wheel (13); and a retainer (153) opposed to the beveled groove (152) to maintain a vertical position for the inserted bit. The chuck of the hand drill clamp on the inner axis sleeve (111) and then tightly mounted by a fitting (16). The drill bit needs to be sharpened is inserted in the inserting hole (151). The spur of the bit can emerge from the beveled groove (152) and contacts with the abrasive wheel (13) to ready for the sharpening procedure. The electrical power transmits to axis (11) when the hand drill is switched on, and it provides the co-axial rotation of the axis (11) and abrasive wheel.

The main drawback of this type of sharpener is that the distance between the base plate (15) and abrasive wheel (13) is not adjustable, and thus the length of the spur emerged from the beveled groove (152) is constant. Therefore, the spur may be over wear out during the sharpening procedure.

There is an another structure to provide an improved sharpener for the bits of drills according to the structure demonstrated in FIG. 1. Referring to FIGS. 2 and 2A, there is a fixing board (131) on the top end of the abrasive wheel (13) and a tray (132) contacted underneath, and they are connected by a screw (13) inside the axis (11). An adjustable tuning base (17) with a positioning groove (171) is mounted on the body (1) and its outer rim connects with the bottom end of the base plate (15). A steel balls (172) in the body (1) is used to adjust the positioning groove (171) on the tuning base (17) to give a proper gap for emerging the spur of drill bit. Additionally, the base plate (15) can be moved upward or downward together with the tuning base (17) to adjust the distance between the base plate (15) and abrasive wheel (13). The spur of the inserted drill bit is then to have an accurate contact with the abrasive wheel (13).

Both the above mentioned sharpeners are suitable sharpening the drill bit for hand drill only. However, there are disadvantages found for the above mentioned sharpeners, such as:

1. During the sharpening, the user should hold the hand drill and vertical press the bit simultaneous, and thus cause the difficulty while switching on and off the hand drill.
2. The chuck of the power drill is vertical downward. The base plate (15) is face to the ground when the chock is locked by the fitting (16). It will cause the difficulty to observe the drill bit during the sharpening.

Therefore, there is a need to provide an improved drill bit sharpening apparatus which is suitable for sharpening the drill bits of both power drill and hand drill.

SUMMARY OF THE APPLICATION

An object of the present invention is to provide an apparatus which is suitable for sharpening the drill bits of both the power drill and hand drill. Additionally, the operation of said apparatus is simple, and the sharpening is accurate.

A drill bit sharpening apparatus is then provided, which comprises the members of base plate, abrasive wheel, body, longitudinal axis, and optionally a lock shell member or tighten system, wherein said base plate member including a base plate with thread on outer surface which possessing several annular aligned inserting holes with different radii, a beveled groove underneath said inserting holes, a retainer locating on the opposite of said beveled groove to generate a suitable gap to emerge the spur of a drill bit need to be sharpened, a bearing on the center of said base plate, and two protrusive bars on the surface of said base plate for grasping;

said abrasive wheel member including an abrasive wheel with a fixing board on the top end and a tray under said fixing board, and a screwing ring for connecting said fixing board and tray which includes a outer circumference with a thread end and a flat end having two opposite flat surfaces, and a inner circumference has two opposite flat surfaces;

said body member including a body with thread on the inner surface used for connecting said thread on the outer surface of said base plate to adjust the distance between said base plate and said abrasive wheel, a positioning groove with a steel ball for fine adjusting said body, a bearing in the center, and a fitting extended from the bottom of said body;

said axis member including an axis with two opposite plane surfaces, clamping groove and slotted head which inserts though the central of said base plate, abrasive wheel and body and extends to said fitting, a shield on a suitable top end position, a C-sharp clip for clamping to said clamping groove on extended bottom end of said axis; and optionally said lock shell member for mounting itself on side fitting of body which including an open end with an inner rim matching to the outer rim of said fitting, a close end with a hexagon hole for fixing the combined apparatus on a main table of a power drill by a set of hexagon screw with wing nut, and an opening on one side of said shell with two protrusive clamping plates each having hexagon hole for inserting another set of hexagon screw and wing nut; or said tighten system for tightening a hand drill to operating the drill bit sharpening, which including a holding frame with an operating screw inserted from a hole of the bottom frame, a horizontal extended clamping ring for holding said hand drill, and an opening including two clamping plates each having a hexagon hole for inserting a set of hexagon screw and wing nut.

DETAILED DESCRIPTION OF THE PREFERRED EMBODIMENT OF THE INVENTION

Figure 1:
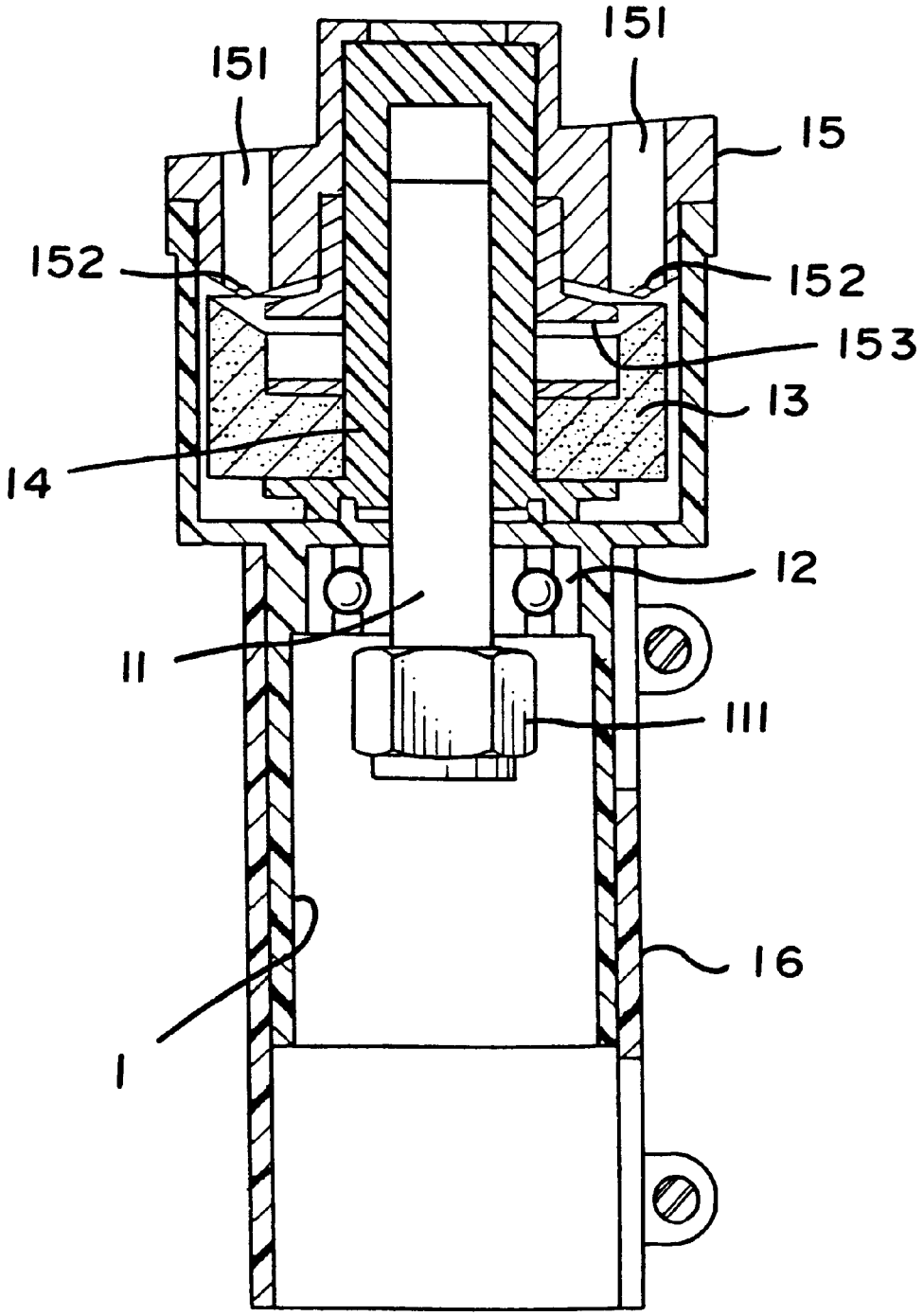
FIG. 1 is a perspective view of a conventional sharpener for drill bits.
Figure 2:
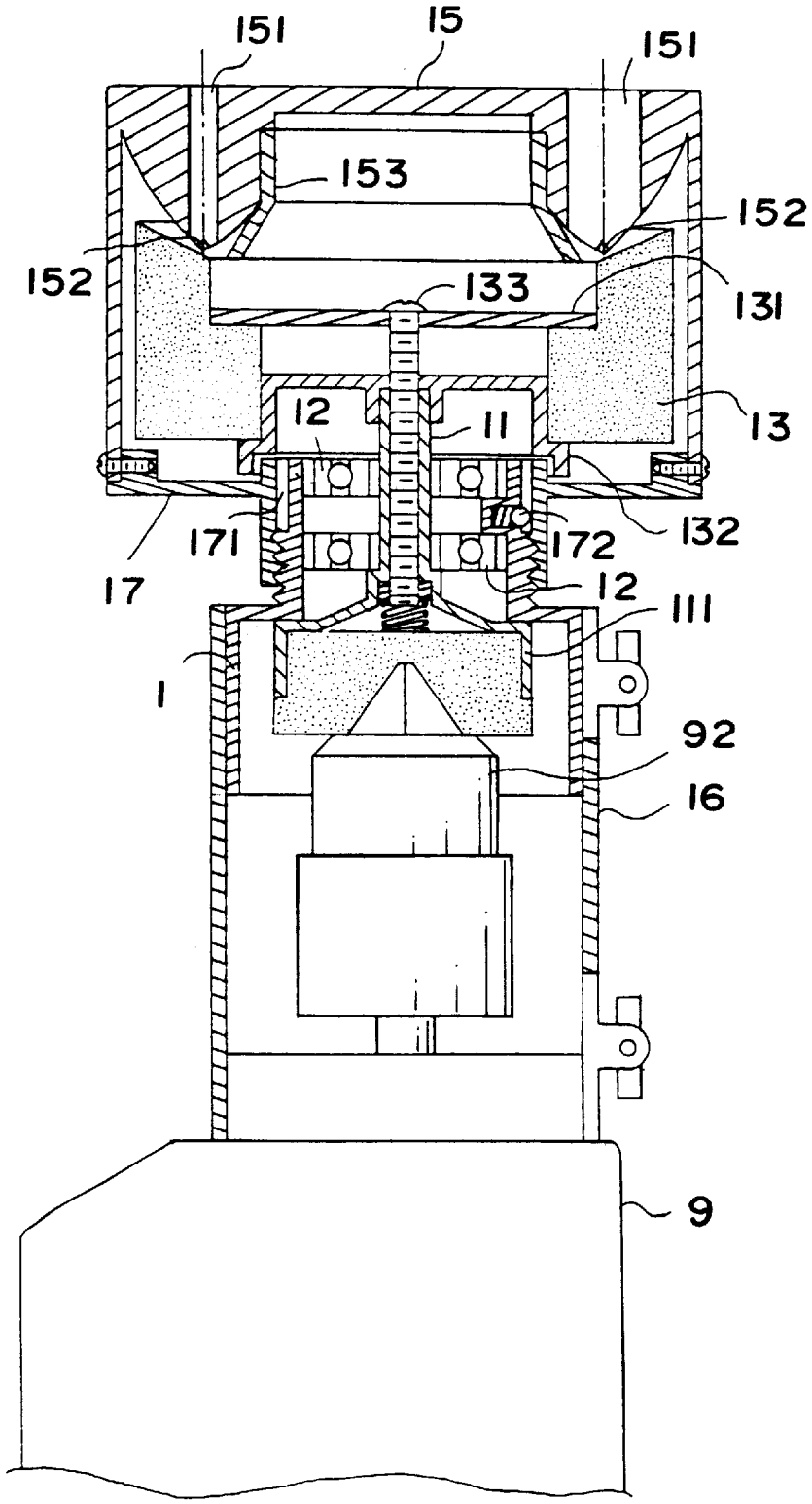
FIG. 2 is a perspective view of another conventional sharpener for drill bits.
Figure 2A:
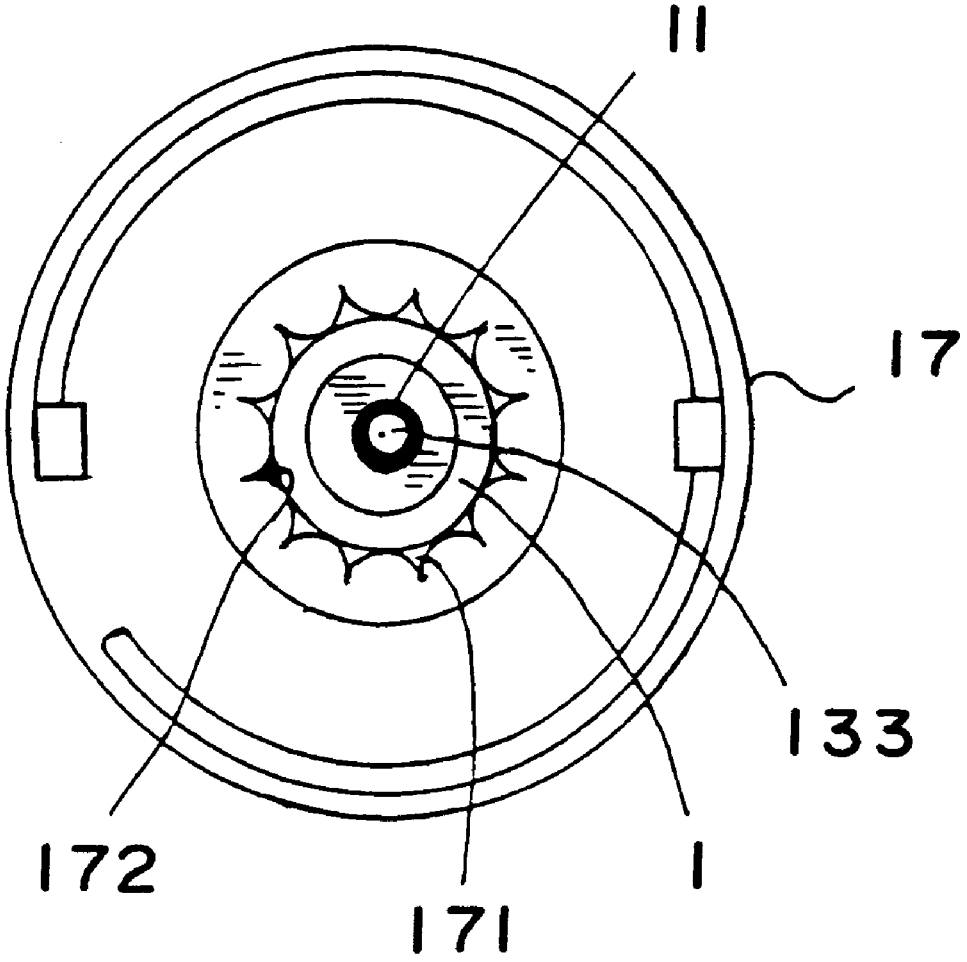
FIG. 2A is a top view of a tuning base (17) of the conventional sharpener for drill bits illustrated in FIG. 2.
Figure 4:
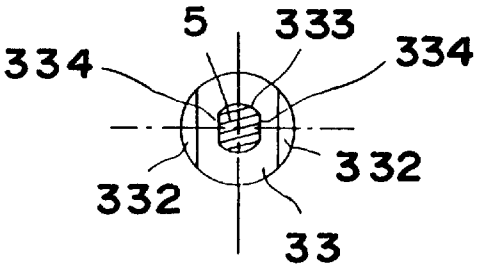
FIG. 4 is an enlarged top view of a preferred embodiment of the invention, looking in the direction of arrows A in FIG. 3.
Figure 5:
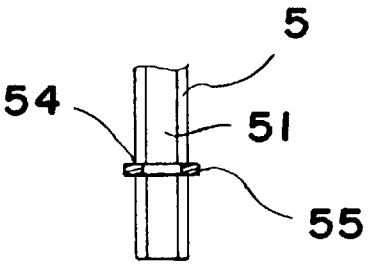
FIG. 5 is a front perspective view of B in FIG. 3.
Figure 3:
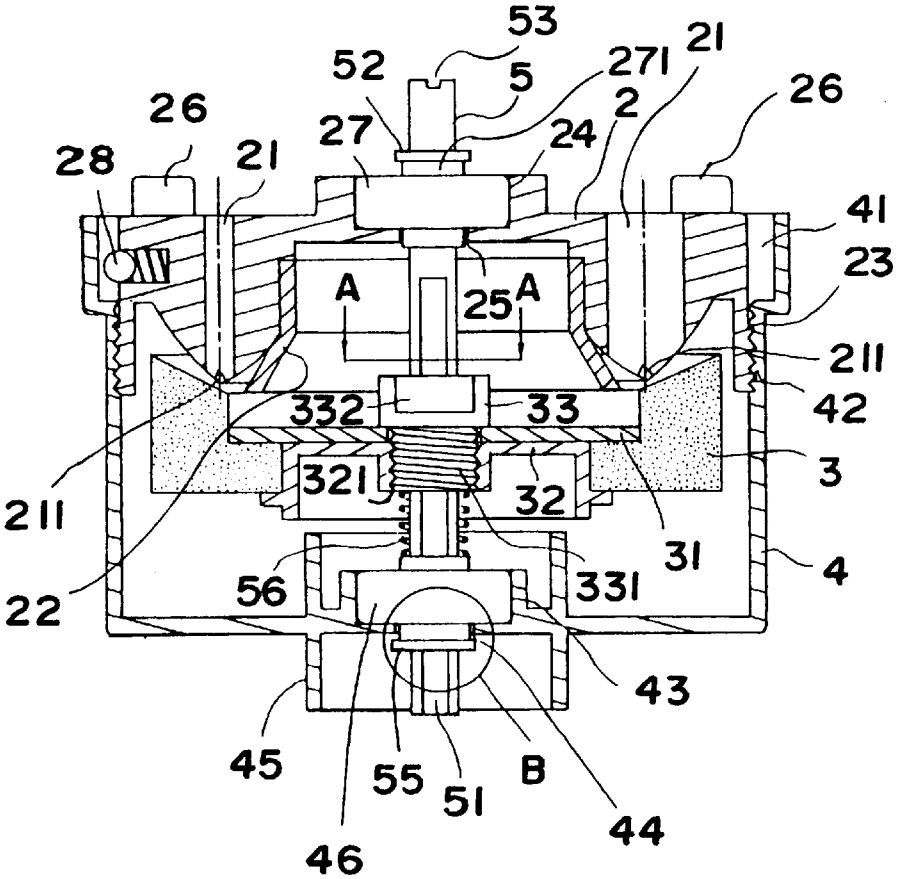
FIG. 3 is a perspective view of a preferred embodiment of the invention.

Referring to FIGS. 3, 4, and 5, the drill bit sharpening apparatus of the present invention including the members of base plate, abrasive wheel, body, longitudinal axis, and optionally lock shell member or tightening system.

The base plate member comprises a base plate (2), inserting holes (21), a beveled groove (211), a retainer (22), a bearing (27), and protrusive bars (26). The base plate (2) possessing several annular aligned inserting holes (21) with different radii from 3.6–10 m/m, and its outer surface has thread (23). The beveled groove (211) position underneath the inserting holes (21). A suitable gap is generated between the beveled groove (211) and a retainer (22) where the spur of the bit can emerge therefrom. Central of the base plate (2) is a bearing ditch (24) for locating a bearing (27) and an axis channel (25). Additionally, on the surface of the base plate (2) has two protrusive bars (26) which can be grasped for screwing easily.

The abrasive wheel member comprising an abrasive wheel (3), a fixing board (31), a tray (32), and a screwing ring (33). On the top end of the abrasive wheel (3) has a fixing board (31) contacted with a tray (32), and they are connected by a screwing ring (33). The outer circumference of the screwing ring (33) includes a thread end (331) and a flat end (332) having two opposite flat surfaces, and its inner circumference has two opposite flat surfaces. The screwing ring (33) is screwed though the tray (32) by using the threads (321) and (331) on the tray (32) and screwing ring (33) respectively. If it is necessary, a tool can be used by clamping on the flat surfaces of flat end (332) of the screwing ring (33) for a better tightening performance.

The body member comprising a body (4), a positioning groove (41) with a steel ball (28), a bearing (46), and a fitting (45). Underneath the positioning groove (41), the thread (42) on the inner surface of the body may connect with the thread (23) on the outer surface of the base plate (2). On the central bottom of the body (4) has a bearing ditch (43) for locating a bearing (46) and an axis channel (44). A fitting (45) extends from the bottom of said body. The axis means comprising an axis (5), a shield (52), a clamping groove (54), a spring (56), and a C-sharp clip (55). The axis (5) has two opposite plane surfaces (51) and slotted head. The shield (52) is mounted on a suitable top end position, and the clamping groove (54) is on a suitable bottom end position for locating the C-sharp clip (55).

In use, the axis (5) is inserted though the bearing (27) till the shield (52) flatly contact with top surface of an axis sleeve (271). Appropriately, the axis (5) also may have a section of longitudinal grooves underneath the shield (52) to increase the fastness in the axis sleeve (271). Additionally, the plane surfaces (51) of the axis (5) match the two flat sides (334) on the inner rim (333) of screwing ring (33), and thus the clamping relationship causes the co-axial rotation of abrasive wheel (3) and axis (5). The axis (5) further inserts though the spring (56) located between the screwing ring (33) and bearing (46) and extends to the fitting (45). The C-sharp clip (55) then clamps to the extended clamping groove (54). The base plate (2) may be adjusted upward and downward by tuning the treads (23) and (24), and a fine adjustment may be achieved by using the steel ball (28) and positioning groove (41).

Figure 6:
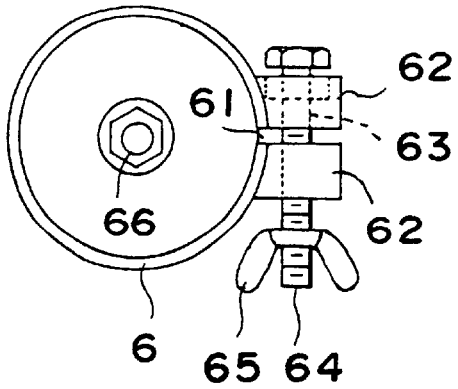
FIG. 6 is a top view of a lock shell (6) in a preferred embodiment of the invention.
Figure 7:
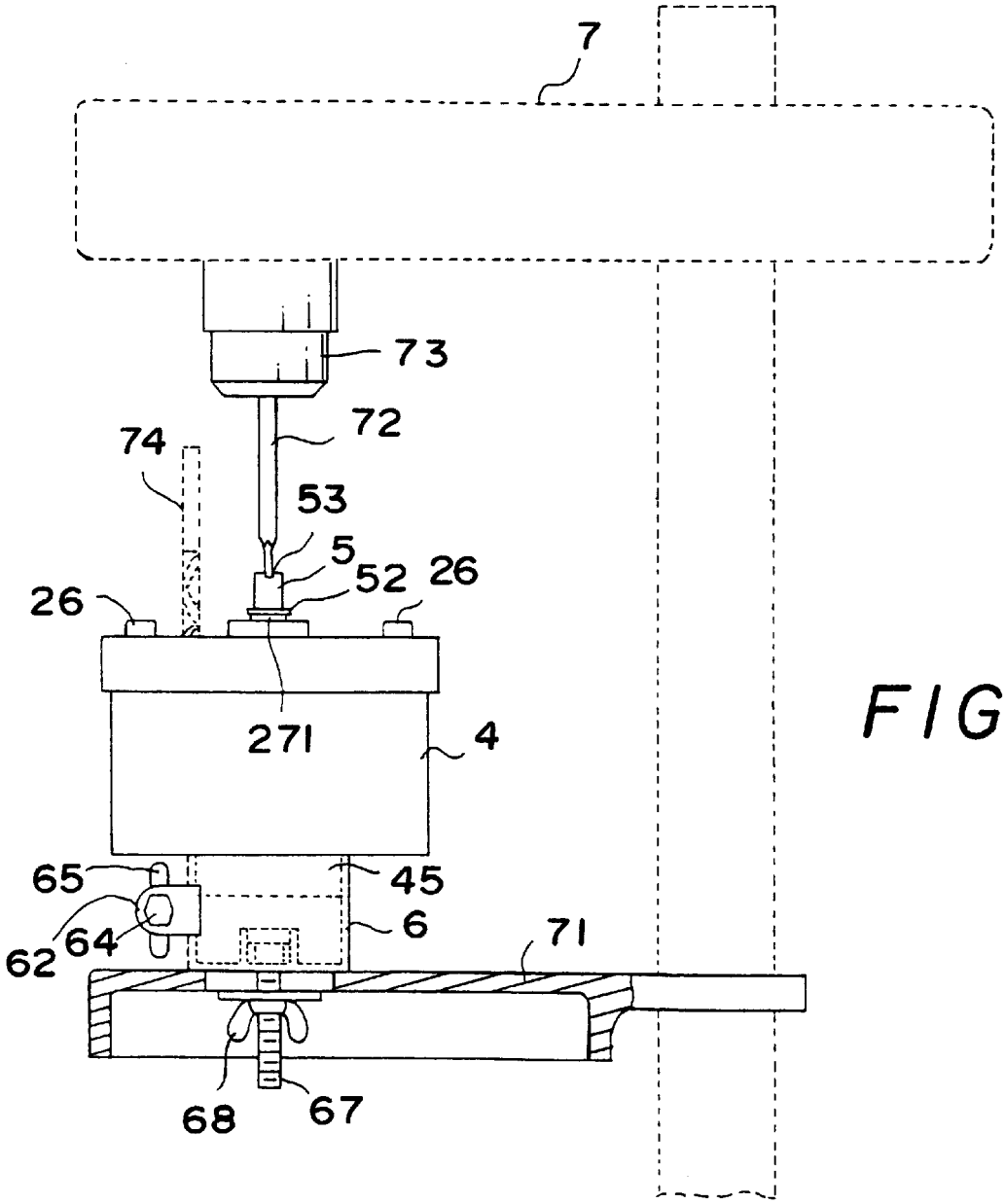
FIG. 7 is a side perspective view of a preferred embodiment of the invention positioned on a main table (71) of a power drill by using a lock shell (6).

FIGS. 6 and 7 demonstrate a further lock shell (6) member for installing the sharpener of the invention on a power drill (7). The lock shell including an open end, a close end, and an opening (61). The inner rim of the lock shell (6) can exactly match the outer rim of the fitting (45). One side of the lock shell (6) is an opening (61) including two protrusive clamping plates (62). There are hexagon holes (63) on the clamping plates (62) for inserting a set of hexagon screw (64) and wing nut (65) for further fasten the lock shell (6) on fitting (45). On the close end, there is a hexagon hole (66), and another set of hexagon screw (67) and wing nut (68) are inserted therefrom for installing the lock shell (6) together with the sharpening apparatus on the main table (71) of a power drill (7). One cabinet tip (72) is chosen and is fixed on a chuck (73) of the drill (7), raising the main table (71) till the cabinet tip (72) is tightly connected on the slotted groove (53) of the axis (5). The rotation energy of the drill (7) transmits to the axis (5) as well as abrasive wheel (3) via the chuck (73). The user may easily insert the drill bit need to be sharpened into a inserting hole (21) to proceed the sharpening.

Figure 9:
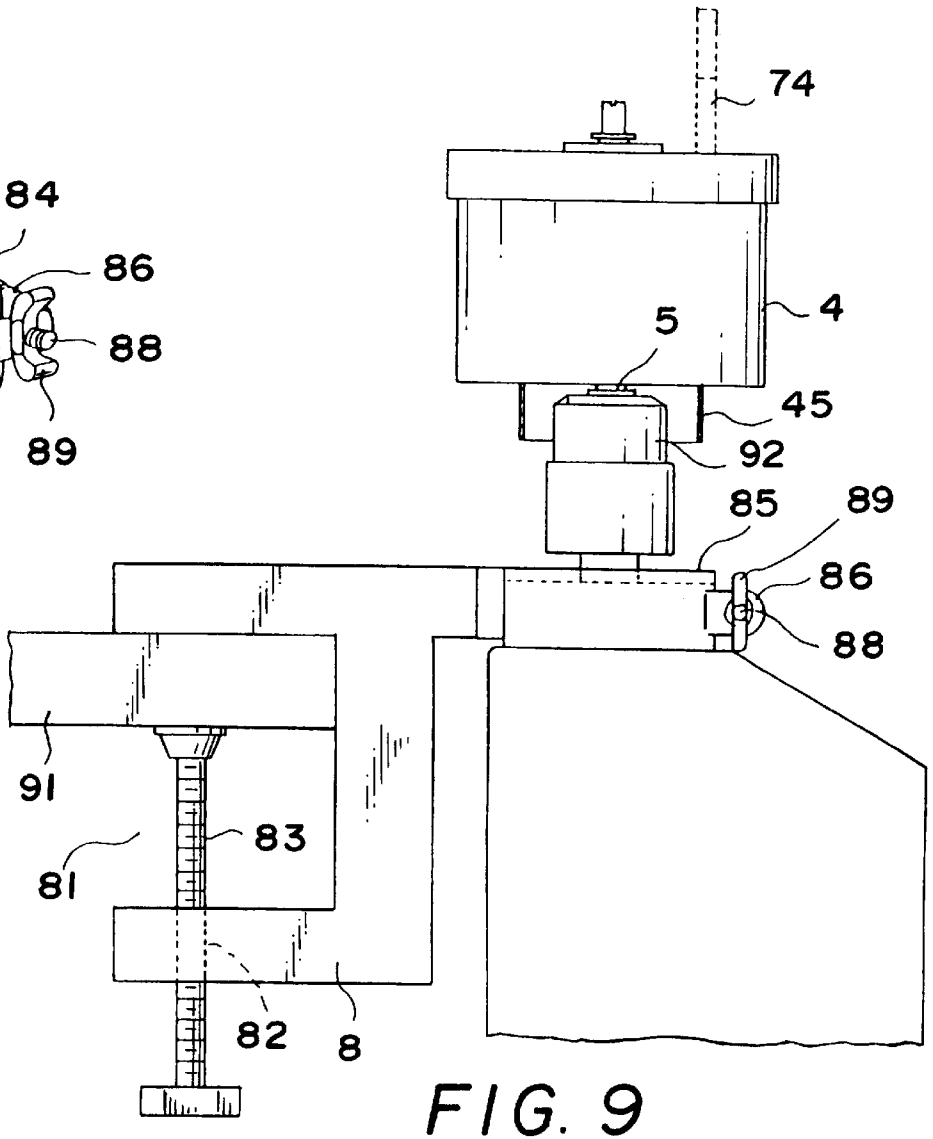
FIG. 9 is a side perspective view of a preferred embodiment of the invention for sharpening a drill bit of a hand drill.
Figure 8:
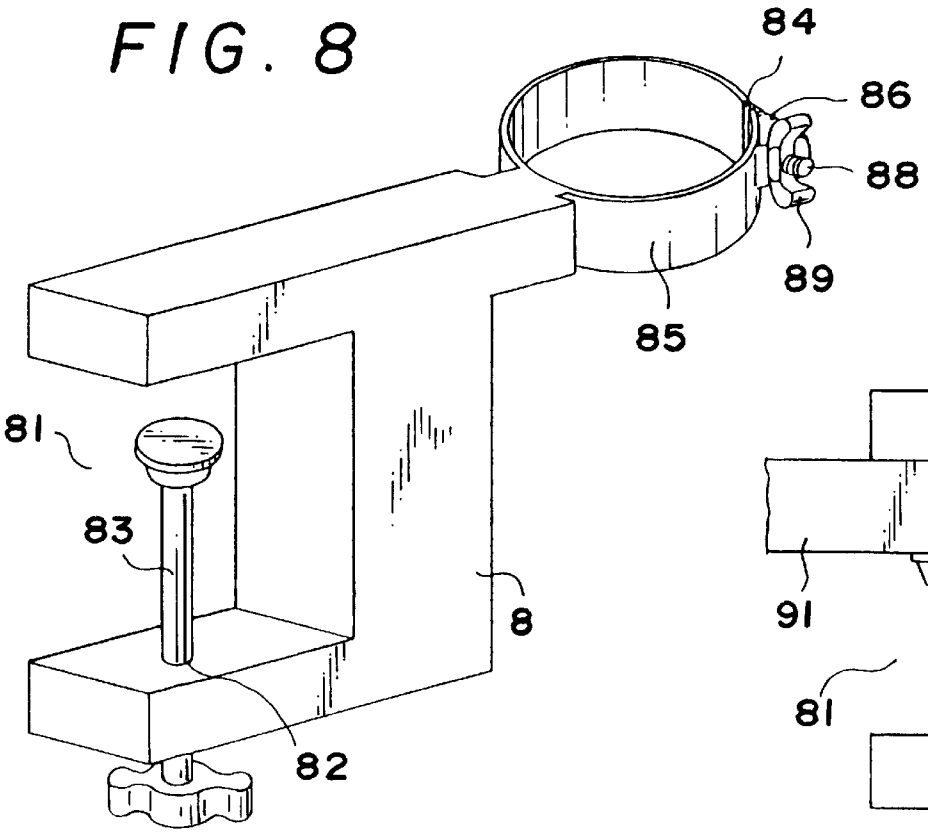
FIG. 8 is a side elevation view of a tighten system (8) in a preferred embodiment of the invention.

FIGS. 8 and 9 demonstrate a further tighten system (8) for tightening a hand drill to operate the sharpening. The tighten system (8) comprising a holding frame (81) which an operating screw (83) is inserted from a hole (82) of the bottom frame; and a horizontal extended clamping ring (85) with an opening (84). The opening (84) has the similar structure as the opening (61) which comprises two clamping plates (86) each having a hexagon hole (87) for inserting a set of hexagon screw (88) and wing nut (89). Therefore, the chuck of the hand drill (9) can be clamped on clamping ring (85) to provide a tighten contact.

The holding frame (81) is fixed on an edge of a bench (91) and is tightly connected with by screwing the operating screw (83). The chuck of the hand drill (9) is vertical upward to grasp the bottom end of the axis (5), and then the sharpening procedure may be operated easily.

Although the present invention has been explained in relation to its preferred embodiment, it is to be understood that many other possible modifications and variations can be made without departing from the spirit and scope of the invention hereinafter claimed.

What is claimed is:

1. A drill bit sharpening apparatus comprises the members of base plate, abrasive wheel, body, longitudinal axis, and optionally a lock shell member or tighten system, wherein said base plate member including a base plate with thread on outer surface which possessing several annular aligned inserting holes with different radii, a beveled groove underneath said inserting holes, a retainer locating on the opposite of said beveled groove to generate a suitable gap to emerge the spur of a drill bit need to be sharpened, a bearing on the center of said base plate, and two protrusive bars on the surface of said base plate for grasping;

said abrasive wheel member including an abrasive wheel with a fixing board on the top end and a tray under said fixing board, and a screwing ring for connecting said fixing board and tray which includes a outer circumference with a thread end and a flat end having two opposite flat surfaces, and a inner circumference has two opposite flat surfaces;

said body member including a body with thread on the inner surface used for connecting said thread on the outer surface of said base plate to adjust the distance between said base plate and said abrasive wheel, a positioning groove with a steel ball for fine adjusting said body, a bearing in the center, and a fitting extended from the bottom of said body;

said axis member including an axis with two opposite plane surfaces, clamping groove and slotted head which inserts though the central of said base plate, abrasive wheel and body and extends to said fitting, a shield on a suitable top end position, a C-sharp clip for clamping to said clamping groove on extended bottom end of said axis; and optionally said lock shell member for mounting itself on side fitting of body which including an open end with an inner rim matching to the outer rim of said fitting, a close end with a hexagon hole for fixing the combined apparatus on a main table of a power drill by a set of hexagon screw with wing nut, and an opening on one side of said shell with two protrusive clamping plates each having hexagon hole for inserting another set of hexagon screw and wing nut; or said tighten system for tightening a hand drill to operating the drill bit sharpening, which including a holding frame with an operating screw inserted from a hole of the bottom frame, a horizontal extended clamping ring for holding said hand drill, and an opening including two clamping plates each having a hexagon hole for inserting a set of hexagon screw and wing nut.

2. A drill bit sharpening apparatus according to claim 1, wherein the axis has a section of longitudinal grooves underneath the shield to increase the fastness in the axis sleeve.

3. A drill bit sharpening apparatus according to claim 1, wherein sharpening the drill bit of power drill comprises choosing one cabinet tip and fixing on the chuck of the power drill, raising the main table till the cabinet tip is tightly connected on the slotted groove of the axis; rotating the drill to transmits the electrical energy to the axis as well as abrasive wheel via the chuck to achieve the sharpening.

* * * * *